US008210266B2

(12) United States Patent
Younger et al.

(10) Patent No.: US 8,210,266 B2
(45) Date of Patent: Jul. 3, 2012

(54) DRILL PIPE

(75) Inventors: Rae Younger, Aberdeenshire (GB); Alex MacGregor, Kirkcudbright (GB); Adrien Bouillet, Avignon (FR); Christian Leuchtenberg, Albany, NY (US)

(73) Assignee: Managed Pressure Operations PTE Ltd., Singapore (SG)

( * ) Notice: Subject to any disclaimer, the term of this patent is extended or adjusted under 35 U.S.C. 154(b) by 274 days.

(21) Appl. No.: 12/425,173

(22) Filed: Apr. 16, 2009

(65) Prior Publication Data

US 2010/0096190 A1 Apr. 22, 2010

(30) Foreign Application Priority Data

Oct. 22, 2008 (GB) ..... 0819340.1
Apr. 3, 2009 (GB) ..... 0905801.7

(51) Int. Cl.
*E21B 34/00* (2006.01)
*E21B 34/06* (2006.01)

(52) U.S. Cl. ..... 166/373; 166/321; 175/317

(58) Field of Classification Search ..... 166/373, 166/321; 175/317; 137/454.2, 535, 540, 137/543.21, 542; 251/205, 248, 268
See application file for complete search history.

(56) References Cited

U.S. PATENT DOCUMENTS 704,423 A 7/1902 Allen
1,491,986 A 4/1924 Greene
2,102,555 A 12/1937 Dyer
2,158,356 A 5/1939 Dyer
3,298,385 A 1/1967 Jackson et al.
3,338,319 A 8/1967 Griffin, III
3,470,971 A 10/1969 Dower
3,762,219 A * 10/1973 Jessup ..... 73/152.23
4,448,267 A 5/1984 Crawford, III et al.
4,685,520 A 8/1987 McDaniel et al.
4,770,389 A 9/1988 Bodine et al.
4,823,877 A 4/1989 McDaniel et al.
4,867,254 A 9/1989 Gavignet
4,901,761 A * 2/1990 Taylor ..... 137/557
5,070,949 A 12/1991 Gavignet
5,080,182 A 1/1992 Thompson
5,115,871 A 5/1992 McCann et al.
5,431,188 A 7/1995 Cove (Continued)

FOREIGN PATENT DOCUMENTS

EP 1248065 A2 10/2002

(Continued)

OTHER PUBLICATIONS

GB International Search Report for GB0905633.4, Aug. 10, 2009, 1 page.

(Continued)

*Primary Examiner* — Cathleen Hutchins
(74) *Attorney, Agent, or Firm* — Bracewell & Giuliani LLP

(57) ABSTRACT

A drill pipe having a tubular body through which is provided a main bore, a side port provided in an exterior surface of the body, a side bore extending through the body from the main bore to the side port, and a valve member which is movable between a closed position in which fluid flow through the side bore is substantially prevented and an open position in which fluid flow through the side bore is permitted, wherein the movement of the valve member between the closed position and the open position comprises translational movement, and the valve member is located at least predominantly within the side bore.

9 Claims, 9 Drawing Sheets

U.S. PATENT DOCUMENTS

| | | | | |
|---|---|---|---|---|
| 5,613,561 | A * | 3/1997 | Moriarty | 166/387 |
| 5,628,493 | A | 5/1997 | McKnight et al. | |
| 5,975,219 | A | 11/1999 | Sprehe | |
| 6,244,631 | B1 | 6/2001 | Payne et al. | |
| 6,315,051 | B1 | 11/2001 | Ayling | |
| 6,374,925 | B1 | 4/2002 | Elkins et al. | |
| 6,739,397 | B2 | 5/2004 | Ayling | |
| 7,028,586 | B2 | 4/2006 | Robichaux | |
| 7,107,875 | B2 | 9/2006 | Haugen et al. | |
| 7,308,952 | B2 | 12/2007 | Strazhgorodskiy | |
| 7,836,973 | B2 | 11/2010 | Belcher et al. | |
| 2005/0092523 | A1 | 5/2005 | McCaskill et al. | |
| 2006/0060360 | A1 | 3/2006 | Moncus et al. | |
| 2006/0124352 | A1 | 6/2006 | Krueger et al. | |
| 2006/0254822 | A1 | 11/2006 | Ayling | |
| 2006/0278434 | A1 | 12/2006 | Calderoni et al. | |
| 2007/0151762 | A1 | 7/2007 | Reitsma | |
| 2007/0231158 | A1 | 10/2007 | Butler et al. | |
| 2009/0025930 | A1 | 1/2009 | Iblings et al. | |
| 2009/0242817 | A1 | 10/2009 | Strazhgorodskiy | |
| 2010/0155143 | A1 | 6/2010 | Braddick | |
| 2010/0200299 | A1 | 8/2010 | Vatne | |
| 2010/0252272 | A1 | 10/2010 | Haughom | |
| 2010/0300543 | A1 | 12/2010 | Braddick | |

FOREIGN PATENT DOCUMENTS

| | | | |
|---|---|---|---|
| EP | 1048819 | B1 | 2/2004 |
| EP | 1754947 | A2 | 2/2007 |
| GB | 2119046 | A | 11/1983 |
| GB | 2290330 | A | 12/1995 |
| GB | 2314106 | A | 12/1997 |
| GB | 2427217 | B | 10/2008 |
| GB | 2451699 | A | 2/2009 |
| WO | 0236928 | A1 | 5/2002 |
| WO | WO 2004074627 | A1 | 9/2004 |
| WO | 2005019596 | A1 | 3/2005 |
| WO | 2005080745 | A1 | 9/2005 |
| WO | WO 2007005822 | A2 | 1/2007 |
| WO | WO 2007124330 | A2 | 11/2007 |
| WO | WO 2008051978 | A1 | 5/2008 |
| WO | WO 2008095650 | A1 | 8/2008 |
| WO | 2008156376 | A1 | 12/2008 |
| WO | 2009018173 | A2 | 2/2009 |
| WO | 2009022914 | A1 | 2/2009 |
| WO | 2010046653 | A2 | 4/2010 |

OTHER PUBLICATIONS

Adri Schouten, PCT International Search Report for PCT/EP2010/054387, Sep. 23, 2010, 2 pages.

Skalle, Pal, "Trends Extracted From 800 Gulf Coast Blowouts During 1960-1996" Society of Petroleum Engineers, IADC/SPE 39354, 1998 IADC/SPE Drilling Conference held in Dallas, Texas, Mar. 3-6, 1998, pp. 539-546.

Schubert, J.A. and Wright, J.C., "Early Kick Detection Through Liquid Level Monitoring in the Wellbore" Society of Petroleum Engineers, IADC/SPE 39400, 1998 IADC/SPE Drilling Conference held in Dallas, TX, Mar. 3-6, 1998, pp. 889-895, Copyright 1998, IADC/SPE Drilling Conference.

Hutchinson, M., Rezmer-Cooper, A and L. and Schlumberger, "Using Downhole Annular Pressure Measurements to Anticipate Drilling Problems" Society of Petroleum Engineers, SPE 49114, 1998 SPE Annual Technical Conference and Exhibition held in New Orleans, LA, Sep. 27-30, 1998, pp. 535-549, Copyright 1998, Society of IADC/SPE Drilling Conference.

PCT International Search Report, dated Nov. 3, 2010, International Application No. PCT/EP2010/063579, filed Sep. 15, 2010.

GB International Search Report for GB0905802.5, Jul. 31, 2009, 2 pages.

Stephane Ott, PCT International Search Report for PCT/GB2010/050571, Dec. 17, 2010, 2 pages.

* cited by examiner

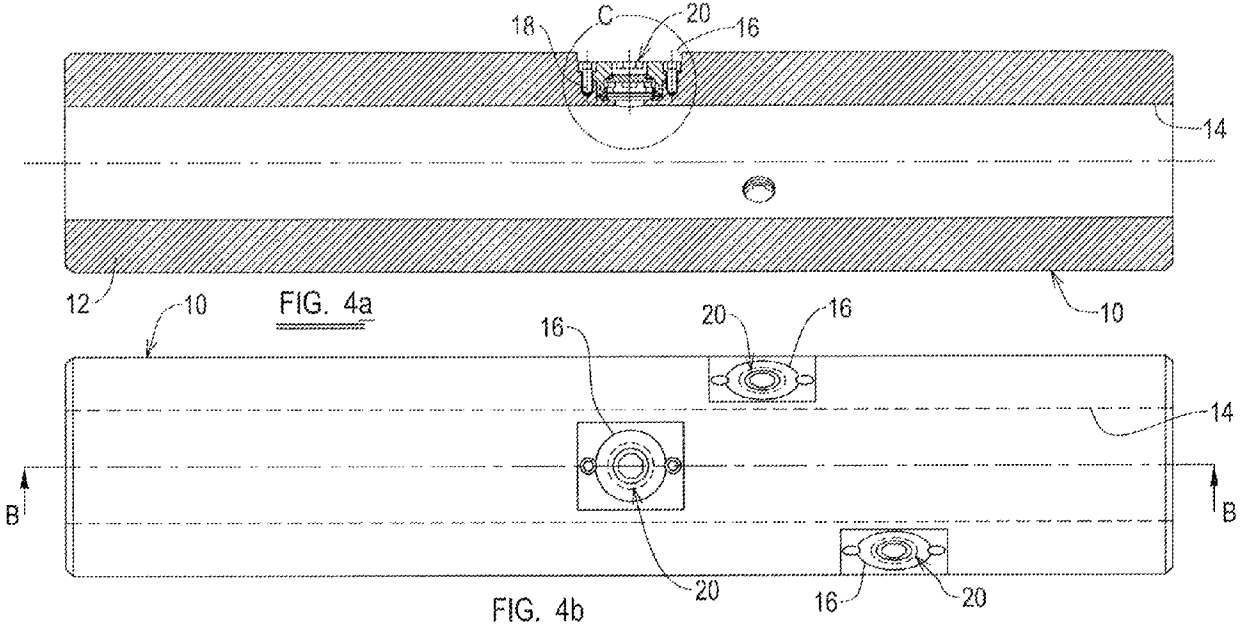
FIG. 4a
FIG. 4b
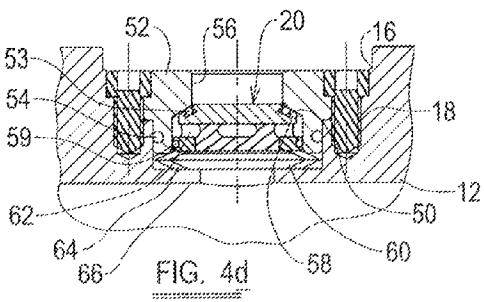
FIG. 4d
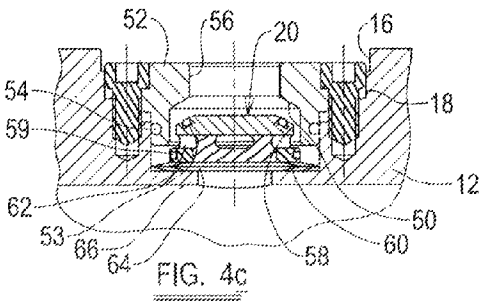
FIG. 4c

DRILL PIPE

RELATED APPLICATIONS

This patent application claims priority to GB Application Number 0819340.1 filed on Oct. 22, 2008 and GB Application, Application Number unknown, filed Apr. 3, 2009, which are incorporated by reference in their entirety.

BACKGROUND TO THE INVENTION

The present invention relates to a drill pipe, in particular a drill pipe including a valve assembly for closing a side bore in the drill pipe.

The drilling of a borehole or well is typically carried out using a steel pipe known as a drill pipe or drill string with a drill bit on the lowermost end. The drill string comprises a series of tubular sections, which are connected end to end.

The entire drill string may be rotated using a rotary table, or using an over-ground drilling motor mounted on top of the drill pipe, typically known as a 'top-drive', or the drill bit may be rotated independently of the drill string using a fluid powered motor or motors mounted in the drill string just above the drill bit. As drilling progresses, a flow of mud is used to carry the debris created by the drilling process out of the borehole. Mud is pumped down the drill string to pass through the drill bit, and returns to the surface via the annular space between the outer diameter of the drill string and the borehole (generally referred to as the annulus). The mud flow also serves to cool the drill bit, and to pressurise the borehole, thus substantially preventing inflow of fluids from formations penetrated by the drill string from entering into the borehole. Mud is a very broad drilling term and in this context it is used to describe any fluid or fluid mixture used during drilling and covers a broad spectrum from air, nitrogen, misted fluids in air or nitrogen, foamed fluids with air or nitrogen, aerated or nitrified fluids to heavily weighted mixtures of oil and or water with solid particles.

Significant pressure is required to drive the mud along this flow path, and to achieve this, the mud is typically pumped into the drill string using one or more positive displacement pumps which are connected to the top of the drill string via a pipe and manifold.

Whilst the main mud flow into the well bore is achieved by pumping mud into the main bore at the very top end of the drill string, it is also known to provide the drill string with a side bore which extends into the main bore from a port provided in the side of the drill string, so that mud can be pumped into the main bore at an alternative location to the top of the drill string.

For example, as drilling progresses, and the bore hole becomes deeper and deeper, it is necessary to increase the length of the drill string, and this is typically achieved by disengaging the top drive from the top of the drill string, adding a new section of tubing to the drill string, engaging the top drive with the free end of the new tubing section, and then recommencing drilling. It will, therefore, be appreciated that pumping of mud down the drill string ceases during this process.

Stopping mud flow in the middle of the drilling process is problematic for a number of reasons, and it has been proposed to facilitate continuous pumping of mud through the drill string by the provision of a side bore in each section of drill string. This means that mud can be pumped into the drill string via the side bore whilst the top of the drill string is closed, the top drive disconnected and the new section of drill string being connected.

In one such system, disclosed in U.S. Pat. No. 2,158,356, at the top of each section of drill string, there is provided a side bore which is closed using a plug, and a valve member which is pivotable between a first position in which the side bore is closed whilst the main bore of the drill string is open, and a second position in which the side bore is open whilst the main bore is closed. During drilling, the valve is retained in the first position, but when it is time to increase the length of the drill string, the plug is removed from the side bore, and a hose, which extends from the pump, connected to the side bore, and a valve in the hose opened so that pumping of mud into the drill string via the side bore commences. A valve in the main hose from the pump to the top of the drill string is then closed, and the pressure of the mud at the side bore causes the valve member to move from the first position to the second position, and hence to close the main bore of the drill string.

The main hose is then disconnected, the new section of tubing mounted on the drill string, and the main hose connected to the top of the new section. The valve in the main hose is opened so that pumping of mud into the top of the drill string is recommenced, and the valve in the hose to the side bore closed. The resulting pressure of mud entering the top of the drill string causes the valve member to return to its first position, which allows the hose to be removed from the side bore, without substantial leakage of mud from the drill string.

The side bore may then be sealed permanently, for example by welding a plug onto the side bore, before this section of drill string is lowered into the well.

The drill string may also be provided with a side bore in what is known as a "pump in sub", which is used in the event of an emergency, for example to facilitate the provision of additional mud pressure required to control a sudden surge in well-bore pressure due to fluid inflow from a formation penetrated by the well entering the well in what is known as a "kick".

SUMMARY OF THE INVENTION

According to a first aspect of the invention we provide a drill pipe having a tubular body through which is provided a main bore, a side port provided in an exterior surface of the body, a side bore extending through the body from the main bore to the side port, and a valve member which is movable between a closed position in which fluid flow through the side bore is substantially prevented and an open position in which fluid flow through the side bore is permitted, wherein the movement of the valve member between the closed position and the open position comprises translational movement, and the valve member is located at least predominantly within the side bore.

This invention may be advantageous, as locating the valve member at least predominantly within the wall thickness of the drill, pipe means that the valve member does not interfere with flow of fluid along the main bore of the drill pipe during normal drilling operation.

Preferably, when in the closed position, the valve member engages with a valve seat to substantially prevent flow of fluid along the side bore, and the valve member is arranged relative to the valve seat such that if the fluid pressure in the main bore of the drill pipe exceeds the pressure at the side port, the valve member is urged into engagement with the valve seat.

The translational movement of the valve member between the closed position and the open position is preferably generally parallel to a longitudinal axis of the side bore.

The drill pipe may include a spring element by means of which the valve member is biased into either the open position or the closed position, and in this case, the spring element preferably acts to bias the valve member to the closed position, the valve member being adapted to be opened by the pressure of fluid at the side port.

Preferably, the valve member has a generally annular bearing surface which, when the valve member is in the closed position, engages with a corresponding annular valve seat provided around the side bore.

The valve member may be provided with a locating part which engages with a guide part, the guide part extending from the drill pipe into the side bore and assisting in maintaining the alignment of the annular bearing surface of the valve member with the valve seat.

Where a spring element is provided, the spring element may comprise a helical spring which extends around the locating part between a stop part mounted on the locating part and the guide part.

The drill pipe may further be provided with a cap which may be releasably secured in the side bore, and when secured in the side bore provides a substantially fluid tight seal with the drill pipe, thus preventing flow of fluid along the side bore. In this case, the cap may be provided with engagement formations which, when secured in the side bore, engage with corresponding engagement formations provided by the drill pipe, rotation of the cap within the side bore being required to bring the respect engagement formations into engagement. The engagement formations may comprise a pair of corresponding screw threads, or include bayonet connector formations which are spaced around the circumference of the side bore and extend radially into the side bore.

According to a second aspect of the invention we provide a drill pipe header having a tubular body through which is provided a main bore, a side port provided in an exterior surface of the body, a side bore extending through the body from the main bore to the side port, and a valve member which is movable between a closed position in which fluid flow through the side bore is substantially prevented and an open position in which fluid flow through the side bore is permitted, wherein the movement of the valve member between the closed position and the open position comprises translational movement, and the valve member is located at least predominantly within the side bore.

The drill pipe header may have any of the features of the drill pipe according to the first aspect of the invention.

According to a third aspect of the invention we provide a sub for connection to a drill pipe having a tubular body through which is provided a main bore, a side port provided in an exterior surface of the body, a side bore extending through the body from the main bore to the side port, and a valve member which is movable between a closed position in which fluid flow through the side bore is substantially prevented and an open position in which fluid flow through the side bore is permitted, wherein the movement of the valve member between the closed position and the open position comprises translational movement, and the valve member is located at least predominantly within the side bore.

The sub may have any of the features of the drill pipe according to the first aspect of the invention.

It should also be appreciated that the drill pipe, drill pipe header or sub may also be provided with a further valve means, such as a standard Kelly or TIW valve, to close the main bore of the drill pipe, for example during attachment of a new length of drill pipe.

BRIEF DESCRIPTION OF THE DRAWINGS

Embodiments of the invention will now be described, by way of example only, with reference to the following drawings of which:

FIG. 4*a* shows a longitudinal cross-section through a fourth embodiment of drill pipe according to the first aspect of the invention with one valve member installed in the drill pipe, FIG. 4*b* shows a perspective illustration of a fourth embodiment of drill pipe according to the first aspect of the invention with three valve members installed in the drill pipe, FIG. 4*c* shows a detailed cross-section through any one of the valve members shown in FIG. 4*a* or 4*b* in the open position, FIG. 4*d* shows a detailed cross-section through of any one of the valve members shown in FIG. 4*a* or 4*b* in the closed position.

DESCRIPTION OF THE PREFERRED EMBODIMENTS

Figure 1A:
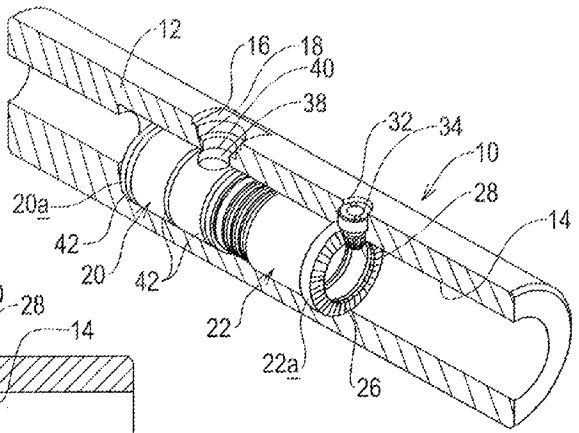
FIG. 1*a* shows a part cross-sectional illustration of a first embodiment of drill pipe not according to the invention.

All of these designs exhibit translational movement of the valve member as opposed to pivoting or rotational movements disclosed in prior art. The designs shown in FIGS. 1 to 3 are advantageous because they provide a better mechanism for keeping the sealing portion free of debris, but have a disadvantage that, because the valve member is located in the main bore of the drill pipe, the valve member may impede flow of fluid along the drill pipe. For the designs disclosed in FIGS. 4, 5 and 6*a*-6*d*, the design results in greater cross-sectional area of the drill pipe at the level of the valve which gives a more torque resistant design of greater strength compared to the design in FIGS. 1 to 3, and also do not substantially restrict flow of fluid along the main bore of the drill pipe, particularly when in the closed position.

Referring now to the figures, in each one there is shown a section of drill pipe 10, having a tubular body 12 through which is provided a main bore 14. As is typical for drill pipes, the exterior surface of the tubular body 12 is generally circular in transverse cross-section, and the main bore 14 is cylindrical and extends axially through the tubular body 14. A side port 16 is provided in the exterior surface of the tubular body 12, and a side bore 18 extends through the tubular body 12 from the main bore 14 to the side port 16, in this example, generally perpendicular to the main bore 14.

The drill pipe 10 is also provided with a valve member 20 which is movable between a closed position in which the valve member 20 substantially prevents fluid flow through the side bore 18 and an open position in which fluid flow through the side bore 18 is permitted, the movement of the valve member 20 between the closed position and the open position comprising translational movement.

Figure 1B:
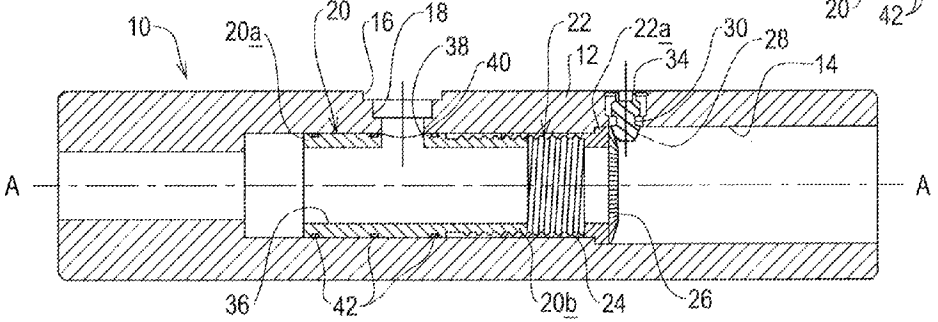
FIG. 1*b* shows a longitudinal cross-section through the portion of drill pipe illustrated in FIG. 1*a* in which the valve member is in the open position.
Figure 1C:
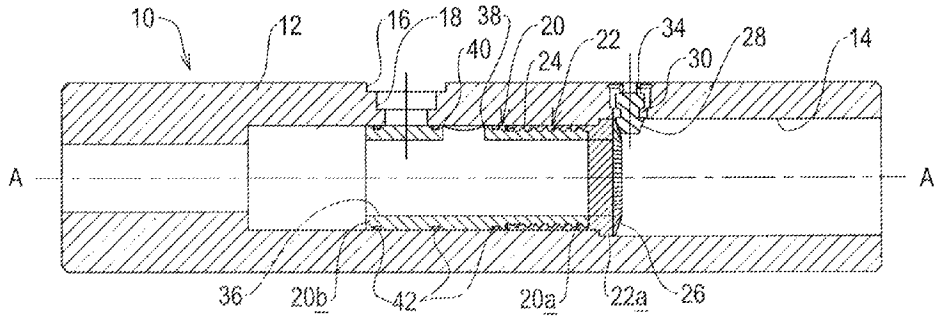
FIG. 1*c* shows a longitudinal cross-section through the portion of drill pipe illustrated in FIG. 1*a* in which the valve member is in the closed position.
Figure 2C:
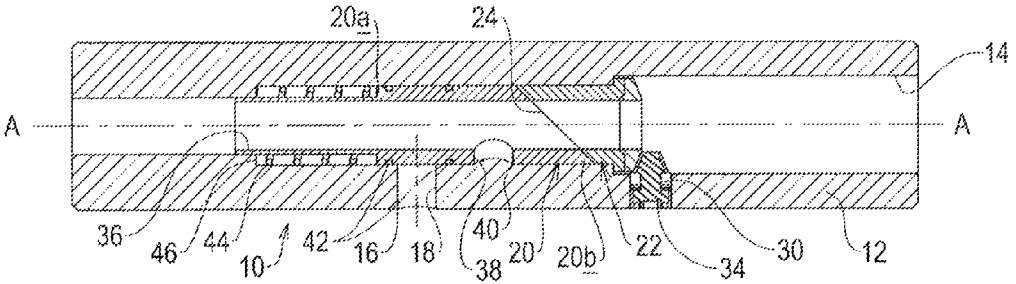
FIG. 2*c* shows a longitudinal cross-section through of the portion of drill pipe shown in FIG. 2*a* in which the valve member is in the closed position.
Figure 2B:
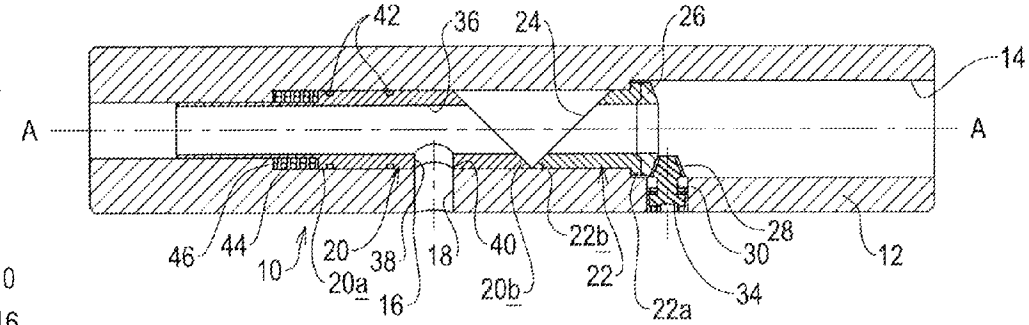
FIG. 2*b* shows a longitudinal cross-section through of the portion of drill pipe shown in FIG. 2*a* in which the valve member is in the open position.
Figure 2A:
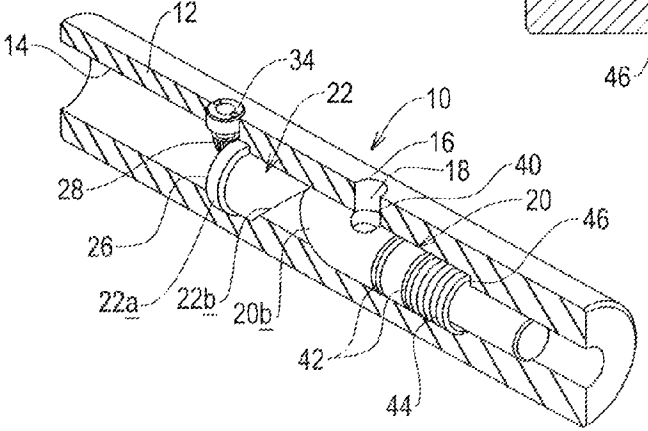
FIG. 2*a* shows a part cross-sectional illustration of a second embodiment of drill pipe not according to the invention.
Figure 3B:
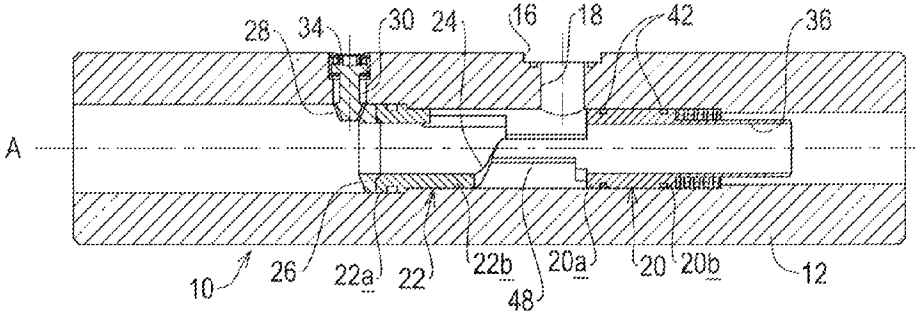
FIG. 3*b* shows a longitudinal cross-section through the portion of drill pipe shown in FIG. 3*a* in which the valve member is in the open position.
Figure 3C:
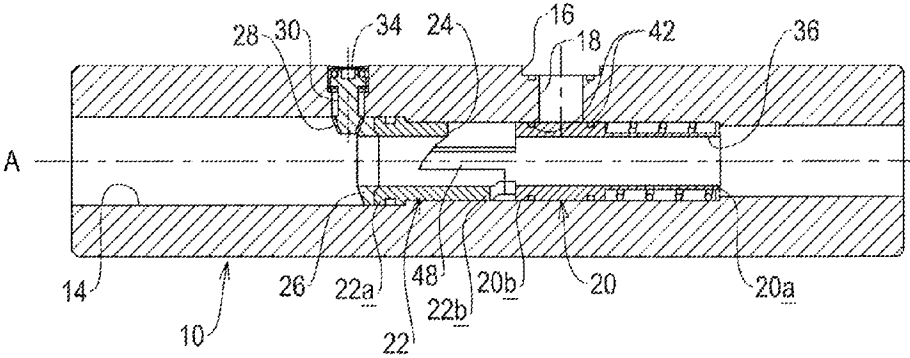
FIG. 3*c* shows a longitudinal cross-section through the portion of drill pipe shown in FIG. 3*a* in which the valve member is in the closed position.
Figure 3A:
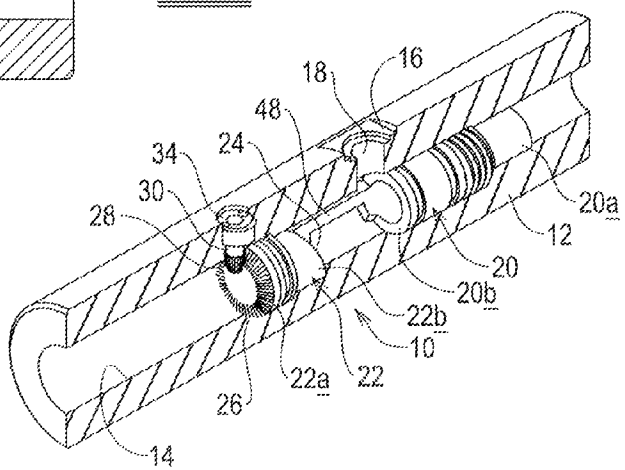
FIG. 3*a* shows a part cross-sectional illustration of a third embodiment of drill pipe not according to the invention.

Referring now to FIGS. 1, 2 and 3, it will be seen that, in these embodiments of the invention, the valve member 20 comprises a cylindrical element which is located within the main bore 14 and which engages with the tubular body 12 of the drill pipe 10 during sliding of the valve member 20 between the open position (illustrated in FIGS. 1*b*, 2*b*, & 3*b*) and the closed position (illustrated in FIGS. 1*c*, 2*c* and 3*c*). Movement of the valve member 20 between the closed position and the open position is achieved using an actuating part 22 which is mounted for rotation within the main bore 14, and which includes a cam surface 24. The cam surface 24 engages with the valve member 20 and is configured such that rotation of the actuating part 22 about an axis coinciding with the longitudinal axis A of the drill pipe 10 causes the valve member 20 to slide in the main bore generally parallel to the longitudinal axis A of the drill pipe 10.

In each case, the actuating part 22 comprises a generally cylindrical tubular sleeve having a first end 22*a* provided with a bevel gear 26 with a plurality of gear teeth which extend generally longitudinally of the drill pipe 10. A portion of these gear teeth 26 engage with one or more corresponding teeth provided in a corresponding smaller bevel gear 28, the two gears thus forming a crown wheel and pinion arrangement. The smaller bevel gear 28 is mounted on the first end of a pin 30, which extends through an aperture provided in the tubular body 12 to a generally cylindrical recess 32 provided in the exterior surface of the tubular body 12. At a second end of the pin 30 is provided a head 34 having a hexagonal recess in which a standard Kelly valve key can be fitted, and used to rotate the smaller bevel gear 28 about the longitudinal axis of the pin 30. This causes the actuating part 22 to rotate about the longitudinal axis of the drill pipe 10, which in turn causes the valve member to slide along the main bore 14.

In the first and second embodiments of the invention, shown in FIGS. 1 and 2, the valve member 20 also comprises a generally cylindrical tubular sleeve, and therefore has a main bore 36 which extends from a first end of the sleeve 20*a* to a second end of the sleeve 20*b*.

The valve member 20 is also provided with a side bore 38 which extends from a port 40 provided in the exterior surface to the main bore 36 of the sleeve 20. An O-ring 42 is mounted in each of two circumferential grooves provided in the exterior surface of the sleeve 20, the separation of which is greater than the diameter of the side bore 18 in the tubular body 12 of the drill pipe 10. The O-rings 42 are located between the port 40 and the second end 20*b* of the sleeve 20. Both provide a substantially fluid tight seal between the sleeve 20 and the drill pipe 10.

When in the open position, as illustrated in FIGS. 1*b*, 2*b*, or 3*b*, the port 40 is aligned with the side bore 18 in the body 12 of the drill pipe 10 so that fluid may flow into the main bore 14 of the drill pipe via the side bores 18 and 38. When in the closed position, as illustrated in FIGS. 1*c*, 2*c*, 3*c*, two of the O-rings 42 are positioned one either side of the side bore 18, thus preventing flow of fluid into the main bore 14 of the drill pipe 10 via the side bore 18.

In the first embodiment, illustrated in FIGS. 1*a*, 1*b* and 1*c*, a third O-ring 42 is provided in a circumferential groove located between the port 40 and the first end 20*a* of the valve member 20. The cam surface 24 comprises a helical thread which extends around the interior surface of the actuating part 22 at the second end 22*b* thereof. This engages with a corresponding helical thread provided around the exterior surface of the valve member 20 at the first end 20*a* thereof. By virtue of this engagement of the threads, it will be appreciated that rotation of the actuating part 22 in a first direction will cause the valve member 20 to slide within the main bore 14 of the drill pipe 10 in a first direction, and rotation of the actuating part 22 in the opposite direction will cause the valve member 20 to slide within the main bore 14 in the opposite direction. Thus, by using a Kelly key to turn the pin 30 secured to the small bevel gear 28, the valve member 20 may be moved between the open position and the closed position.

In the first embodiment, the inter-engaged screw threads ensure that rotation of the actuating part 22 in a first direction results in movement of the valve member 20 from the closed position to the open position, and rotation of the actuating part 22 in the opposite direction results in movement of the valve member 20 from the closed position to the open position.

This is not the case for the second and third embodiments, however, and it is necessary to provide resilient biasing means to return the valve member 20, in these examples, to the open position from the closed position. In these examples, the resilient biasing means comprises a helical compression spring 44, which extends between a shoulder 46 provided in the interior surface of the drill pipe 10, and the second end of the valve member 20*b*. The spring 44 is compressed as the valve member 20 is moved from the closed position to the open position, and therefore urges the valve member 20 back to the closed position when the force from the actuating part 22 driving the valve member 20 is released.

In the second embodiment, illustrated in FIGS. 2*a*, 2*b* and 2*c*, the first end of the sleeve 20*a* and the second end of the actuating part 22*b* are cut at around a 45° angle relative to the longitudinal axis A of the drill pipe 10. Thus, when the actuating part 22 is in a first orientation relative to the sleeve 20, such that the first end of the valve member 20*a* is generally parallel to the second end of the actuating part 22*b*, the ends 20*a*, 22*b* mate, and the valve member 20 lies in the closed position as illustrated in FIG. 2*c*. If the actuating part 22 is rotated about the longitudinal axis of the drill pipe 10 through 180°, the second end of the actuating part 22*b* pushes the valve member 20 along the main bore 14 away from the actuating part 22 until the first end of the valve member 20*a* lies perpendicular to the second end 22*b* of the actuating part 22. The valve member 20 thus moves into the open position as illustrated in FIG. 2*b*.

In the third embodiment, illustrated in FIG. 3, valve member 20 is of a slightly different configuration, and is provided with a cylindrical portion which has a marginally smaller diameter than the main bore 14 of the drill pipe 10. Again, an O-ring 42 is mounted in each of two circumferential grooves provided in the exterior surface of the cylindrical portion, the separation of which is greater than the diameter of the side bore 18 in the tubular body 12 of the drill pipe 10. The O-rings 42 provide a substantially fluid tight seal between the sleeve 20 and the drill pipe 10, and thus when the valve member 20 is positioned such that the O-rings 42 lie either side of the side bore 18 in the tubular body 12 of the drill pipe 10, fluid flow into the main bore 14 is substantially prevented, and the valve member 20 is in the closed position. An actuating rod 48 extends from the cylindrical portion towards the second end of the actuating part 22*b*, and bears on a generally helical cam surface provided at the second end of the actuating part 22*b*.

A helical compression spring 44 is provided just as in the second embodiment of the invention.

Rotation of the actuating part 22 therefore causes the valve member 20 to slide along the main bore 14 of the drill pipe 10. The parts are arranged such that the valve member 20 is in the closed position when it is as close to the actuating part 22 as possible, and rotation of the actuating part 22 through 360° causes the valve member 20 to be pushed away from the actuating part 22 against the biasing force of the spring 44 into the open position. When the actuating part 22 is returned to its original orientation, the spring 44 pushes the valve member 20 back to the closed position.

Rather than arranging the valve member in the main bore of the drill pipe, it is preferred to locate the valve member at least predominantly in the side bore. Embodiments of the invention are shown in FIGS. 4*a*, 4*b*, 4*c*, 4*d*, 5*a*, 5*b*, 5*c*, 5*d*, 6*a*, 6*b*, 6*c*, and 6*d*, and in these, the valve member 20 is provided in the side bore 18 of the drill pipe 10, and engages with a circular valve seat 50 provided in the wall of the side bore 18.

The fourth embodiment, illustrated in FIG. 4*a*, comprises a Belleville check valve in which the valve member 20 is mounted in a generally cylindrical valve housing 52 which is retained in a corresponding recess at the side port 16 in the exterior surface of the drill pipe 10. In this example, the valve housing is retained by means of two bolts, but it will be appreciated that it could be retained some other way, for example by providing a screw thread for engagement with a corresponding screw thread in the side port 16. An O-ring 54 is mounted in a circumferential groove provided in the exterior surface of the valve housing 52 and provides a fluid tight seal between the valve housing 52 and the tubular body 12 of the drill pipe 10.

The valve housing 52 is also provided with a central bore 56 which is generally parallel to the side bore 18 and in which is located the valve member 20. The diameter of the central bore is greater adjacent to the exterior of the drill pipe 10 than it is at the end of the valve housing closest to the main bore 14 of the drill pipe 10, and the shoulder formed at the transition between the larger diameter portion and the smaller diameter portion forms the valve seat 50 with which the valve member 20 engages to close the side bore 18.

The valve member 20 is located in the larger diameter portion of the valve housing 52, and comprises a circular bearing part 58 with a generally circular groove in which is located a further O-ring 53. This O-ring 53 engages with the valve seat 50 when the valve member 20 is in the closed position, as illustrated in FIG. 4*d*, and provides a substantially fluid tight seal which prevents flow of fluid along the side bore 18 into the main bore 14 of the drill pipe 10. To ensure that the valve member 20 is correctly located in the valve housing 52, the housing is provided with a cylindrical wall 60 which extends generally perpendicular towards the main bore 14 of the drill pipe 10. Yet another O-ring 59 is located in a circumferential groove provided in the lower end of the valve member 20 closer to the drill pipe bore and this provides a substantially fluid tight seal between the valve member 20 and the valve housing 52. Apertures 62 are provided in the wall 60 between the two O-rings 53 and 59 in the valve member 20, so that when the valve member 20 is in the open position, as illustrated in FIG. 4*c*, with the bearing part 58 and O-ring 53 spaced from the valve seat 50, fluid can flow into the side port 16, between the O-ring 53 and the valve seat 50, through the apertures 62 into the cylindrical space surrounded by the wall 60 and into the main bore 14 of the drill pipe 10.

A Belleville spring 64 is positioned between the valve member 20 and a shoulder 66 provided in the wall of the side bore 18 which urges the valve member 20 into the closed position. In order to move the valve member 20 from the closed position to the open position, it is necessary to apply an external force to the valve member 20 sufficient to overcome the biasing force of the Belleville spring 64. In this embodiment of the invention, no actuating part is provided to achieve this. Instead, the valve member is configured so movement of the valve member 20 from the closed position to the open position can be achieved by the application of fluid pressure to the valve member 20 at the exterior of the drill pipe 10. In use, a connector is provided to connect a hose from a mud pump to the side bore 18 in the drill pipe, and when the pump is activated, the mud pressure in the hose builds up until it is sufficient to push the valve member 20 into the side bore 18 so that the O-ring 53 moves away from the valve seat 50 and mud can flow through the side bore 18.

In cases where the diameter of the side bore 18 cannot be sufficiently large to provide the desired fluid flow rate into the main bore 14 of the drill pipe 10 without comprising the mechanical integrity of the drill pipe, the drill pipe 10 may be provided with more that one side bore 18, each of which has a valve member 20. An example of such a drill pipe 10, having three side bores 18, is shown in FIG. 4*b*.

Figure 5D:
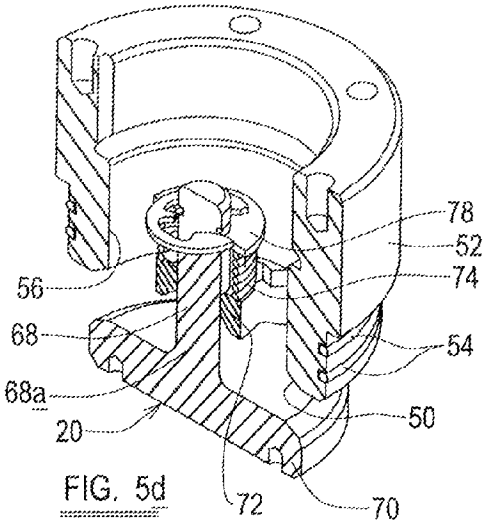
FIG. 5*d* shows a cut open perspective view of the valve illustrated in FIG. 5*b*.
Figure 5C:
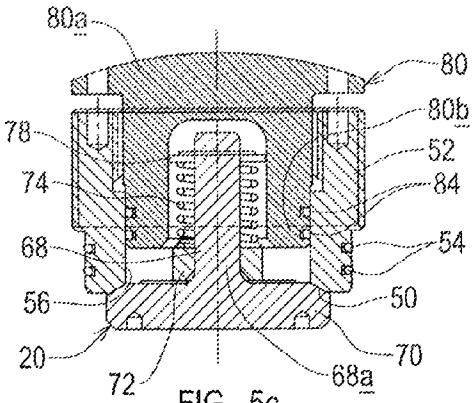
FIG. 5*c* shows a detailed illustration of a cross section through one of the valves shown in FIG. 5*a* in the closed position with a closure cap.
Figure 5B:
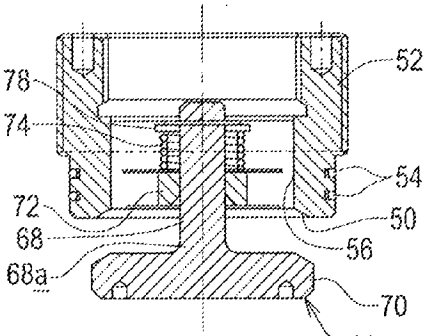
FIG. 5*b* shows a detailed illustration of a cross section through one of the valves shown in FIG. 5*a* in open position.
Figure 5A:
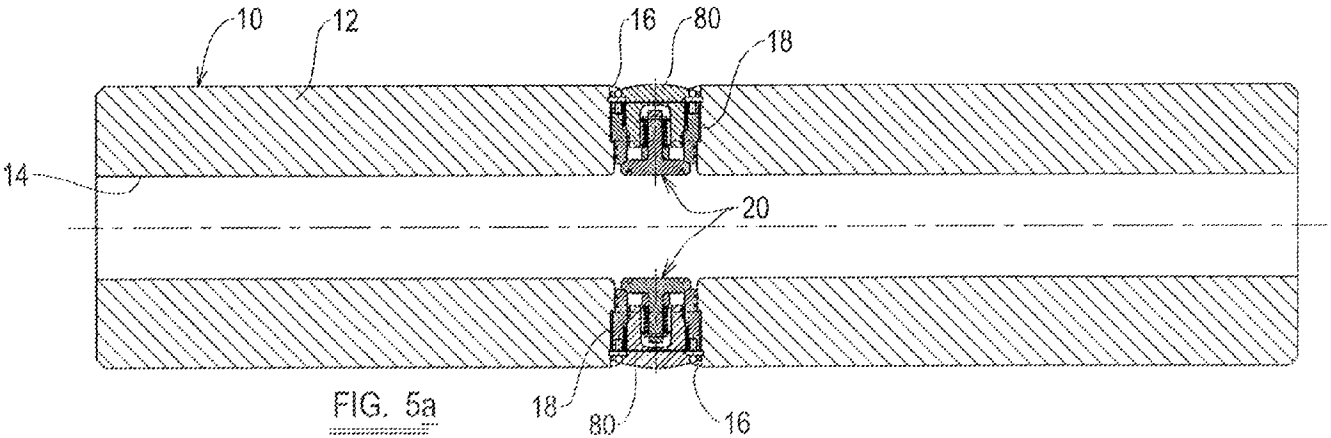
FIG. 5*a* shows a longitudinal cross-section through a fifth embodiment of drill pipe according to the first aspect of the invention with two valves installed in the drill pipe.

The fifth embodiment, illustrated in FIG. 5*a*, comprises a poppet check valve which is similar to the Belleville valve arrangement shown in FIG. 4 in that the valve member 20 is mounted in a generally cylindrical valve housing 52 which is retained in a corresponding recess at the side port 16 in the exterior surface of the drill pipe 10. In this example, two side bores 18 are provided in the drill pipe, and each valve housing 52 is retained by means of a screw thread 53 which engages with a corresponding screw thread in the side port 16, but it will be appreciated that bolts, or any other appropriate fastening means could be used. Alternatively the valve housing could be integral with the tubular body 12 of the drill pipe. Two O-rings 54 are mounted each in a circumferential groove provided in the exterior surface of the valve housing 52 and provides a fluid tight seal between the valve housing 52 and the tubular body 12 of the drill pipe 10. The valve housing 52 is also provided with a central bore 56 which is generally parallel to the side bore 18 in the drill pipe and in which is located the valve member 20.

The valve member 20 is, however, configured differently to the valve member 20 in the Belleville check valve, and includes a stem 68 one end of which is mounted centrally on a disc 70 so that the stem 68 extends generally normal to the disc 70 to a free end of the stem 68*a*. A circular valve seat 50 is provided at the interior end of the valve housing 52 which is adjacent the main bore 14 of the drill pipe 10. The valve member 20 is located such that the stem extends into the central bore 56 of the valve housing 52 from the interior end thereof, whilst the disc 70 lies in the side bore without protruding into said main bore 14 of the drill pipe, outside the valve housing 52 and adjacent the interior end thereof. The diameter of the disc 70 is greater than the diameter of the central bore 56 of the valve seat diameter of the valve seat 50, and when the valve member 20 is in the closed position, the disc 70 engages with the valve seat 50, providing a generally fluid tight seal which substantially prevents fluid flow along the side bore 18 in the drill pipe.

In order to locate the valve member 20 radially within the central bore 56 of the valve housing 52, an annular flange 72 is provided which extends from the valve housing 52 into the central bore 56. The flange 72 includes a central aperture which is just slightly larger in diameter than the stem 68 of the valve member 20, and the stem 68 of the valve member 20 extends through this aperture. The valve member is biased into the closed position by means of a helical spring 74 which extends between a generally circular groove 76 provided in the flange 72 and a collar 78 fixed to the free end of the stem 68*a*. It is therefore necessary to move the valve member 20 against the biasing force of the spring 74 in order to move it out of the closed position to the open position, in which fluid can flow through the central bore 56 via the space between the valve seat 50 and disc 70. Again, as with the fourth embodiment of the invention, the valve member 20 is configured such that this may be achieved by the supply of pressurised fluid to a hose connected to the side bore 18 of the drill pipe 10.

The central bore 56 of the valve housing 52 is threaded 82 so that a cap 80 can be provided as illustrated in FIG. 5*c*. The cap 80 is provided with a generally circular top part 80*a* from which extends a generally cylindrical wall 80*b* of smaller diameter than the top part 80*a*. The wall 80*b* extends into the central bore 56 of the valve housing 52, and is provided with two O-rings 84 each of which is located in a circumferential groove around the exterior surface of the wall 80*b*. The screw thread by means of which the cap 80 is retained in the valve housing 52 is provided on the exterior surface of the wall 80*a* between the top part 80*a* and the O-rings 84.

The O-rings 84 engage with the central bore 56 of the valve housing 52 to provide a substantially fluid tight seal. This ensures that the cap 80 provides a secondary seal preventing fluid flow through the side bore 18 in the drill pipe 10 in case the seal provided by the valve member 20 fails.

Other fastening means may be used to retain the cap 80 in the valve housing 52. For example, a bayonet lock or similar type of quick connection methods may be used instead of the thread.

During the usual operational mode of the drill pipe there exists a pressure inside the drill pipe bore 14 that forces the valve member 20 against the seat 50. To use the valve, the cap 80 is removed. The cap 80 may also be provided with a relief slot (not shown) to allow safe venting of any pressure trapped in the central bore 56. Once the cap 80 is removed an adapter (not shown) can be threaded into the thread 82 with similar O-rings to the O-rings 84 on the cap 80 being provided to ensure a substantially fluid tight seal between the valve housing 52 and the adapter. Fluid pressure can then be supplied through this adapter which will start lifting the disc 70 from the seat once the applied pressure is sufficient to overcome the biasing force of the spring 74 and exceeds the internal pressure in the bore 14 of the drill pipe. At this point the valve is opened 5*b* and flow will pass through the circumferential clearance 86 into the bore 14 of the drill pipe 10.

Once the flow is stopped, and the pressure in the adapter is reduced below the pressure in the drill pipe the valve 20 will close. The spring 74 will always ensure that the valve is held in a closed position at all times when there is no pressure applied from the internal bore of the drill pipe and there is no pressure applied externally.

The valve housing 52' and valve member 20' of a sixth embodiment of drill pipe are illustrated in FIGS. 6*a*, 6*b*, 6*c*, and 6*d*. These are very similar in configuration to the valve housing 52 and valve member 20 of the fifth embodiment of the invention, and equivalent parts are labelled with the same reference numerals with the addition of ', and are not described in detail below. Instead, only the specific differences will be described in detail.

In this embodiment, instead of being secured to the drill pipe by means of a screw thread, the valve housing 52' is provided with a plurality (in this example four) locking studs 82 which each pass through a threaded aperture extending radially outwardly through the valve housing 52' from the interior of the valve housing 52' to the exterior of the valve housing 52'. Each locking stud 82 is threaded and the interior end 82*a* is provided with a head having a hexagonal recess which may be engaged with an Allen key. To secure the valve housing 52' to a drill pipe, the valve housing 52' is inserted into the side port with the locking studs 82 retracted so that they do not extend beyond the exterior surface of the valve housing 52'. The valve housing 52' is then rotated in the side bore to ensure that the locking studs 82 are aligned with corresponding apertures provided in the wall of the side port, and an Allen key engaged with the head 82*a* of each stud 82 in turn and used to screw the stud 82 into the apertures in the drill pipe. Removal of the valve housing 52' from the side port is therefore prevented. It will be appreciated, however, that such locking studs 82 may be provided in addition to a screw thread connection.

A fluid tight seal between the valve housing 52' and the drill pipe is, in this case, provided by means of a single O-ring 54'.

In this embodiment, the arrangement used to secure the spring 74' (which in this example is a wave spring) is also slightly different to that used in the fifth embodiment of the invention. Specifically, the free end 68*a*' of the stem 68' of the valve member 20' is threaded, and a nut 84 is screwed onto this threaded portion. The spring 74', which is located around the stem 68' of the valve member 20', is sandwiched between the flange 72' and the nut 84. A stop 86 is also provided to restrict the extent to which the spring 74' may be compressed. In this example, the stop 86 comprises a collar which has a threaded annular part 86*a* which engages with the screw thread provided on the valve stem 68', and a tubular part 86*b* which extends from the annular part 86*a* towards the disc 70' and encloses a generally cylindrical space around the stem 68' of the valve member 20' into which the spring 74' extends. Engagement of the tubular part 86*b* with the flange 72' sets the maximum possible compression of the spring 74'.

Figure 6A:
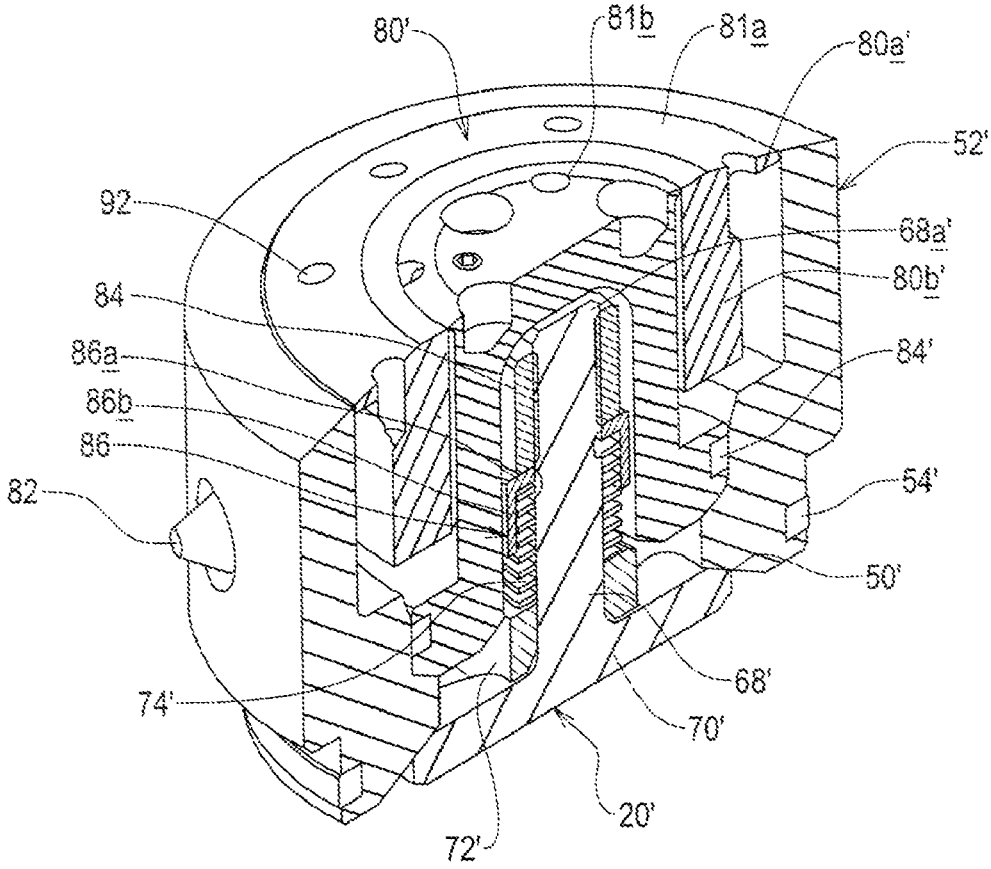
FIG. 6*a* shows a first longitudinal cross-section through a valve assembly for use in a sixth embodiment of drill pipe according to the invention.
Figure 6B:
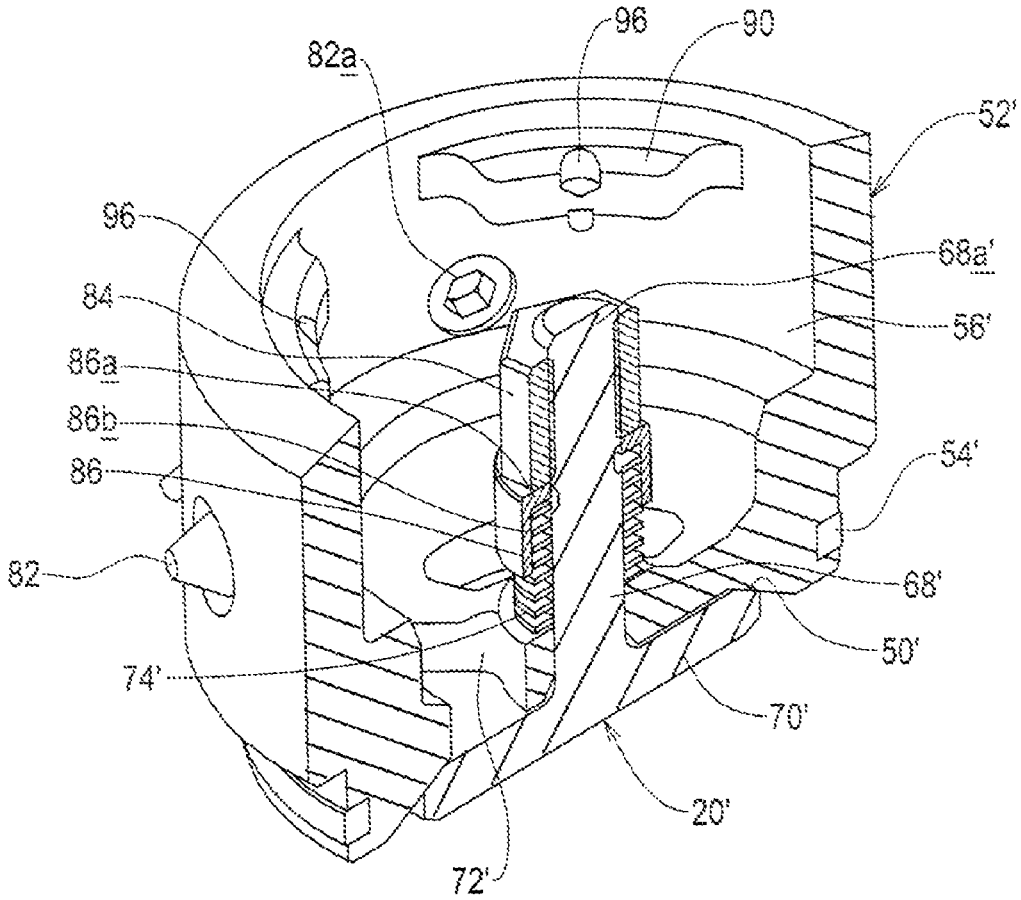
FIG. 6*b* shows a first longitudinal cross-section through the valve assembly shown in FIG. 6*b* without the closure cap.
Figure 6C:
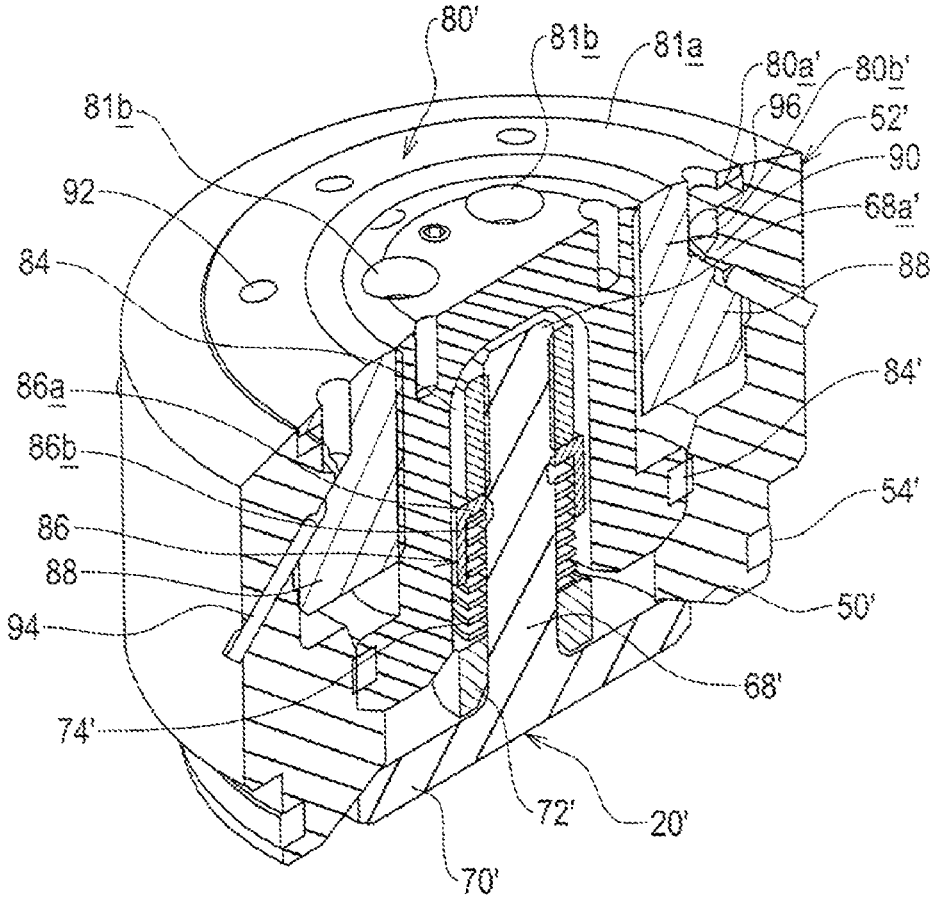
FIG. 6*c* shows a second longitudinal cross-section through the valve assembly shown in FIG. 6*a*.
Figure 6D:
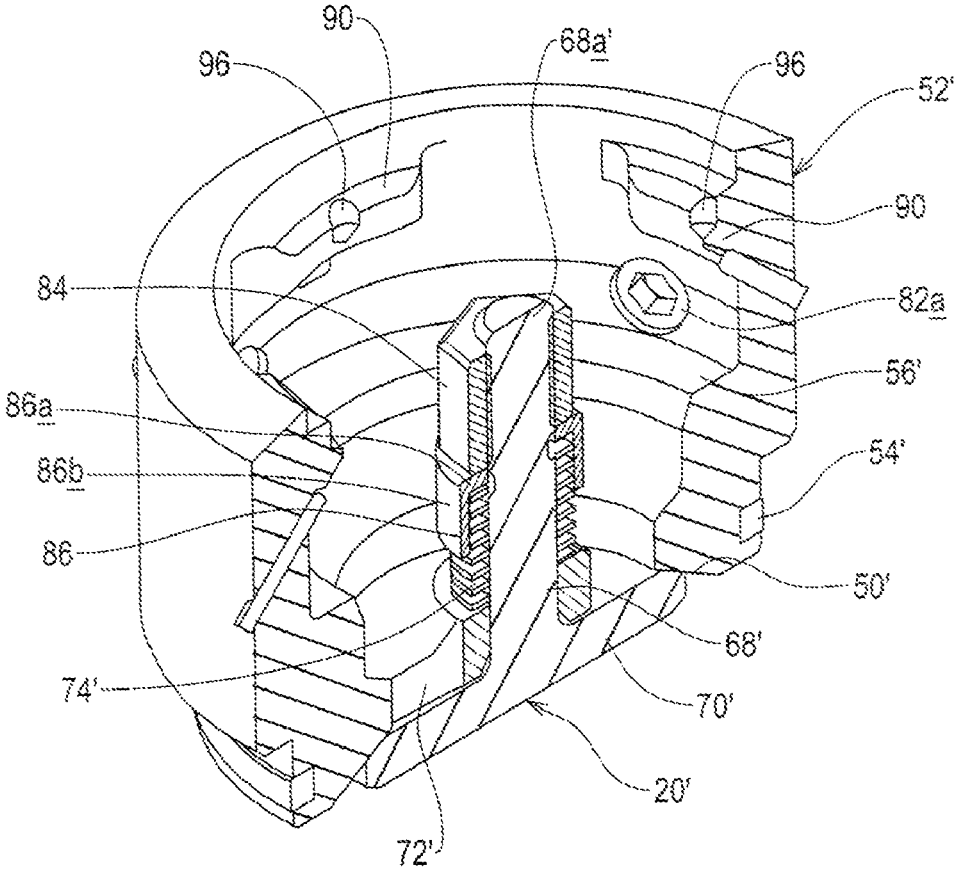
FIG. 6*d* shows a second longitudinal cross-section through the valve assembly shown in FIG. 6*a* without the closure cap.

This embodiment is also provided with a cap 80', which is illustrated in FIGS. 6*a* and 6*c* only, but in this case, instead of using a screw thread to secure the cap 80' to the valve housing 52', bayonet connection formations 88 (seen only in FIG. 6*c*) are provided on the exterior surface of the wall 80*b*' of the cap 80'. In this example, four such bayonet connector formations 88 are provided, and are spaced generally evenly around the wall 80*b*' of the cap 80, the spaces between adjacent bayonet connector formations occupying around half of the outer circumference of the wall 80*b*' in total. The bayonet connector formations 88 each engage with a corresponding lip formation 90 (illustrated in FIGS. 6*b*, 6*c* and 6*d*) which extends into the central bore 56' of the valve housing 52'. As such, in this example, four lip formations 90 are provided, and these are regularly spaced around the circumference of the interior surface of the valve housing 52', occupying less than half of the circumference in total.

The valve housing 52' is also provided with four locking pins 94 (seen only in FIG. 6*c*) which extend through apertures provided in the valve housing 52' from the exterior of the valve housing 52', diagonally upwardly to the interior of the valve housing 52'. Corresponding recesses, large enough to accommodate the interior ends of the locking pins 94 are provided in the centre of the bayonet connector formations 88 of the cap 80'.

The cap 80' is thus secured to the valve housing 52' as follows. The cap 80' is orientated so that each of the bayonet connector formations 88 is aligned with one of the gaps between adjacent lip formations 90. The cap 80' is inserted into the central bore 56' of the valve housing 52' from the exterior of the drill pipe until the top part 80*a'* is slightly below the exterior end of the valve housing 52', and is then rotated through around 45° until each of the bayonet connector formations 88 engages with one of the lip formations 90, and each locking pin 94 is located in the corresponding recess provided in the bayonet connector formation 88. Engagement of the bayonet connector formations 88 with the lip formations 90 of the valve housing 52' thus prevents withdrawal of the cap 80' from the valve housing 52', with the location of the locking pins 94 in the recesses in the bayonet connector formations 88 ensuring that the cap 80' is correctly aligned relative to the valve housing 52' to achieve maximum contact between the bayonet connector formations 88 and the lip formations 90, and to impede rotation of the cap 80' relative to the valve housing 52' out of that alignment.

To assist in achieving the rotation required to engage the bayonet connection formations 88 with the lip formations 90, the top part 80*a'* of the cap 80' is provided with a plurality of apertures 92 into which a special tool, may be inserted. The cap 80' may thus be rotated by rotation of the tool. In this example, eight such apertures 92 are provided, and thus the tool is provided with eight corresponding pins. In order to assist a user in ascertaining when the cap 80' is correctly aligned relative to the valve housing 52', the exterior surfaces of the lip formations 90 of the valve housing 52' are provided with corresponding apertures 96 which, when the cap 80' is in the correct alignment, line up with the apertures 92 in the cap 80'. Thus, when the cap 80' is correctly aligned relative to the valve housing 52', the pins of the tool can slot into the apertures 96 in the lip formations 90. The user will feel this as a sudden movement of the tool in towards the valve housing 52', and can therefore be reassured that the alignment of the cap 80' is correct and no further rotation is required.

In this example, the mating surfaces of the bayonet connector formation 88 and the lip formations are angled at around 45° to the longitudinal axis of the valve housing 52', the radially inward portions of the mating surfaces being closest to the exterior of the drill pipe.

Whilst the cap 80' may be a unitary structure, in this example it is made in two parts, and outer part 81*a*, which provides the outer periphery of the top 80*a'* and the portion of the wall 80*b'* including the bayonet connector formations 88, and an inner part 81*b* which provides the central portion of the top 80*a'* and a lower portion of the wall 80*b'* which has a circumferential groove in which an O-ring 84' is located. The outer, part 81*a* and inner part 81*b* are fastened together by means of engagement of a screw thread which is provided around the exterior of the central part 81*b* and the interior of the outer part 81*a*. As the lower portion of the wall 80*b'* in which the O-ring 84' is provided has an outer diameter which is greater than the internal diameter of the outer part 81*a*, when assembling the cap 80' it is necessary to screw the central part 81*b* into the outer part 81*a* before inserting the cap 80' into the valve housing 52'.

The apertures 92 used to rotate the cap 80' to bring the bayonet connector formations 88 into locking engagement with the lip formations 90 are provided in the outer part 81*a* of the cap 80'. The provision of such a two part structure is therefore advantageous, as, during this rotation of the outer part 81*a*, engagement of the screw threads of the outer and inner parts 81*a*, 81*b* causes the outer part 81*a* to move slightly towards the exterior of the drill pipe, thus bringing the bayonet connector formations 88 into tight engagement with the lip formations 90, and prevents any substantial movement of the cap 80' in the housing 52'.

In this example, as the diameter of the top part 80*a'* of the cap 80 is less than the internal diameter of the valve housing 52' at the exterior end of the valve housing 52', the top part 80*a'* of the cap 80' can be inserted into the central bore 56' of the valve housing 52' so that it is flush with the exterior surface of the drill pipe, rather than engaging with the outer end of the valve housing 52' as in FIG. 5*c*. This means, however, that alternative means of preventing the cap 80' from being pushed too far into the central bore 56' of the valve housing 52' are required. In this example, this is achieved by providing a reduced internal diameter portion of the valve housing 52' at the interior end of the housing 52', the valve seat 50' being provided on the end surface of the reduced internal diameter portion of the valve housing 52'.

When the cap 80' is correctly positioned in the valve housing 52', the bayonet connector formations 88 lie between the lip formations 90 and the reduced diameter portion, the O-ring engages with the valve housing to provide a substantially fluid tight seal between the valve housing 52' and the cap 80' (the cap 80' therefore providing a back-up seal in case the seal provided by engagement of the valve member 20' with the valve seat 20' fails), and the end of the wall 80*b'* of the cap 80' (in this example provided by the central portion 81*b*) engages with a shoulder provided by the reduced diameter portion of the valve housing 52'. The engagement of the end of the cap wall 80*b'* with this shoulder prevents any further movement of the cap 80' into the central bore 56' of the valve housing 52'.

As with the fifth embodiment, once the cap 80' is removed an adapter (not shown) provided with corresponding bayonet connector formations can be engaged with the lip formations 90 of the valve housing 52', and if the adapter is provided with a similar O-ring to the O-ring 84' on the cap 80', this will ensure a substantially fluid tight seal between the valve housing 52 and the adapter. Fluid pressure can then be supplied through this adapter into the main bore of the drill pipe as described above in relation to the fifth embodiment.

It should be appreciated that, whilst in the fourth, fifth and sixth embodiments described above, the valve member 20 is mounted in a valve housing 52, this need not be the case, and the valve member 20 could equally be mounted directly in the body 12 of the drill pipe 10.

If the fluid pressure in the adapter is balanced relative to the fluid pressure in the main bore, it will be appreciated that the fluid pressure in the adapted may not be sufficient to move the valve member to the open position, in which case, the adapter may be provided with a mechanical actuator to push the valve member off the valve seat 50, 50' to the open position. The mechanical actuator may automatically do this, when the adapter is secured to the drill pipe, or manual operation of the actuator may be required.

Locating the valve member 20 in the side bore 16 of the drill pipe 10, as in the fourth, fifth and sixth embodiments of the invention is particularly advantageous as it ensures that the valve member can be located entirely within the wall thickness of the drill pipe, and, at least when in the closed position, not extend into the main bore where it might interfere with flow of fluid along the main bore. This may, of course, be achieved using other configurations of valve member 20, and the valve member 20 need not be exactly as described above. Any other configuration of valve member with a bearing surface which can provide a substantially fluid tight seal with a generally circular valve seat could be used. For example, the valve member 20 could be spherical. The fourth, fifth and sixth embodiments of valve member 20, in which the bearing surface is provided on a generally circular disc, are, however, particularly advantageous, as they can be used to seal a relatively large diameter side bore 18 without occupying too much space along the axis of the side bore 18. If a ball valve member were used, the dimension of the valve member along the axis of the side bore 18 would be much greater relative to the diameter of the side bore 18, and this could cause difficulties in ensuring that the valve member 18 is entirely located within the wall thickness of the drill pipe 10.

It should be appreciated that one advantage of all the embodiments of the invention described above is that all the components required for closing the side bore are contained within the drill pipe. Whilst this need not be the case—the valve member could, for example, comprise a tubular sleeve which is located around the exterior surface of the drill pipe, locating the valve member 20 entirely within the drill pipe 10 is advantageous as it will not impede insertion of the drill pipe 10 into a well bore, which it could do if it were external to the drill pipe 10.

Although not shown in the figures, conventional drill pipe has at at least one of its free ends a connector portion with an enlarged outer diameter. Advantageously, the section of drill pipe 10 in which the side bore 18 is provided is part of the connector portion, as this portion has an increased wall thickness compared with the remainder of the drill pipe. This, of course, is particularly advantageous in relation to the fourth and fifth embodiments of the invention as positioning of the side bore 18 in the area of increased wall thickness provides maximum space for the valve member 20. The side bore 18 could, however, be provided elsewhere in the drill pipe body, or could be provided in a heavy weight drill pipe or drill collar, in which the entire length of the drill pipe 10 has an enlarged wall thickness. The invention could also be applied for casing used in drilling a well-bore in a process known generally to persons skilled in the art as casing drilling. Similarly, invention can be applied to a sub such as a pump in sub, a drilling sub, a saver sub or a cross-over sub, each of which are smaller lengths of tubing which are adapted to be connected to the end of a length of drill pipe.

It should also be appreciated that the drill pipe or sub may also be provided with a further valve means, such as a standard Kelly or TIW valve, to close the main bore of the drill pipe, for example, during attachment of a new length of drill pipe. Such valves are commonly used as an isolation valve in the drill string and consist typically of a rotating ball valve that is manually actuated, and which is located within the main bore of the drill pipe or sub.

Whilst in the embodiments of the invention described above, sealing is generally provided by means O-rings which are typically made of rubber, any other conventional sealing systems, including metal-to-metal seals, may be employed instead.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A drill pipe having a tubular body through which is provided a main bore, a side port provided in an exterior surface of the body, a side bore extending through the body from the main bore to the side port, and a valve member which is movable between a closed position in which fluid flow through the side bore is substantially prevented and an open position in which fluid flow through the side bore is permitted, wherein:

the movement of the valve member between the closed position and the open position comprises translational movement, and the valve member is located at least predominantly within the side bore;

the drill pipe includes a spring element by means of which the valve member is biased into either the open position or the closed position; and the valve member is provided with a locating part which engages with a guide part, the guide part extending from the drill pipe into the side bore and assisting in maintaining the alignment of the annular bearing surface of the valve member with the valve seat and wherein the spring element comprises a generally helical spring which extends around the locating part between a stop part mounted on the locating part and the guide part.

2. The drill pipe according to claim 1 wherein, when in the closed position, the valve member engages with a valve seat to substantially prevent flow of fluid along the side bore, and the valve member is arranged relative to the valve seat such that if the fluid pressure in the main bore of the drill pipe exceeds the pressure at the side port, the valve member is urged into engagement with the valve seat.

3. The drill pipe according to claim 1 wherein the spring element acts to bias the valve member to the closed position.

4. The drill pipe according to claim 1 wherein the valve member has a generally annular bearing surface which, when the valve member is in the closed position, engages with a corresponding annular valve seat provided around the side bore.

5. A drill pipe having a tubular body through which is provided a main bore, a side port provided in an exterior surface of the body, a side bore extending through the body from the main bore to the side port, and a valve member which is movable between a closed position in which fluid flow through the side bore is substantially prevented and an open position in which fluid flow through the side bore is permitted, wherein:

the movement of the valve member between the closed position and the open position comprises translational movement, and the valve member is located at least predominantly within the side bore;

the drill pipe is further provided with a cap which may be releasably secured in the side bore, and when secured in the side bore provides a substantially fluid tight seal with the drill pipe, thus preventing flow of fluid along the side bore;

the cap is secured to the side bore by bayonet connector formations; and locking pins are provided which impede further rotation of the cap relative to the drill pipe when the cap is secured to the drill pipe by means of the bayonet connector formations and is in a desired orientation relative to the drill pipe.

6. The drill pipe according to claim 5 wherein when the cap is in the desired orientation, the locking pins extend from the drill pipe into recesses provided in the bayonet connector formations.

7. A drill pipe having a tubular body through which is provided a main bore, a side port provided in an exterior surface of the body, a side bore extending through the body from the main bore to the side port, and a valve member which is movable between a closed position in which fluid flow through the side bore is substantially prevented and an open position in which fluid flow through the side bore is permitted, wherein:

the movement of the valve member between the closed position and the open position comprises translational movement, and the valve member is located at least predominantly within the side bore;

the drill pipe is further provided with a cap which may be releasably secured in the side bore, and when secured in the side bore provides substantially fluid tight seal with the drill pipe, thus preventing flow of fluid along the side bore;

the cap is secured to the side bore by bayonet connector formations; and an outer surface of the cap is provided with apertures which, when the cap is secured to the drill pipe by means of the bayonet connector formations and is in a desired orientation relative to the drill pipe, are aligned with respect to corresponding apertures in the drill pipe.

8. A drill pipe having a tubular body through which is provided a main bore, a side port provided in an exterior surface of the body, a side bare extending through the body from the main bore to the side port, and a valve member which is movable between a closed position in which fluid flow through the side bore is substantially prevented and an open position in which fluid flow through the side bore is permitted, wherein:

the movement of the valve member between the closed position and the open position comprises translational movement, and the valve member is located at least predominantly within the side bore;

the drill pipe is further provided with a cap which may be releasably secured in the side bore, and when secured in the side bore provides a substantially fluid tight seal with the drill pipe, thus preventing flow of fluid along the side bore;

the cap is secured to the side bore by bayonet connector formations; and the cap is made in two parts, an outer part which includes the bayonet connector formations, and an inner part, the outer and inner parts being fastened together using a screw thread.

9. The drill pipe according to claim 8 wherein the outer part of the cap is provided with apertures which, when the cap is secured to the drill pipe by means of the bayonet connector formations and is in a desired orientation relative to the drill pipe, are aligned with respect to corresponding apertures in the drill pipe.

* * * * *

UNITED STATES PATENT AND TRADEMARK OFFICE

CERTIFICATE OF CORRECTION

PATENT NO. : 8,210,266 B2
APPLICATION NO. : 12/425173
DATED : July 3, 2012
INVENTOR(S) : Rae Younger et al.

It is certified that error appears in the above-identified patent and that said Letters Patent is hereby corrected as shown below:

Column 15, Line 19, Claim 7
replace
"the side bore provides substantially fluid tight seal with"
with
"the side bore provides a substantially fluid tight seal with"

Column 16, Line 2, Claim 8
replace
"surface of the body, a side bare extending through the body"
with
"surface of the body, a side bore extending through the body"

Signed and Sealed this
Twenty-fifth Day of December, 2012

David J. Kappos

David J. Kappos
*Director of the United States Patent and Trademark Office*